US009550944B2

(12) United States Patent
Andrei et al.

(10) Patent No.: US 9,550,944 B2
(45) Date of Patent: Jan. 24, 2017

(54) PROCESS FOR THE RECOVERY OF BITUMEN FROM AN OIL SAND

(71) Applicant: ENI S.p.A., Rome (IT)

(72) Inventors: Maria Andrei, Mediglia (IT); Lucilla Del Gaudio, San Donato Milanese (IT); Giulia Luisa Eleonora Bozzano, Milan (IT); Andrea Sliepcevich, Milan (IT)

(73) Assignee: ENI S.p.A., Rome (IT)

( * ) Notice: Subject to any disclaimer, the term of this patent is extended or adjusted under 35 U.S.C. 154(b) by 291 days.

(21) Appl. No.: 14/351,784

(22) PCT Filed: Oct. 24, 2012

(86) PCT No.: PCT/IB2012/055849
§ 371 (c)(1),
(2) Date: Apr. 14, 2014

(87) PCT Pub. No.: WO2013/064940
PCT Pub. Date: May 10, 2013

(65) Prior Publication Data

US 2014/0238904 A1 Aug. 28, 2014

(30) Foreign Application Priority Data

Oct. 31, 2011 (IT) ..... M12011A1977

(51) Int. Cl.
*C10G 1/04* (2006.01)

(52) U.S. Cl.
CPC ..... *C10G 1/045* (2013.01); *C10G 1/047* (2013.01); *C10G 2300/208* (2013.01);

(Continued)

(58) Field of Classification Search
CPC ... C10G 1/045; C10G 1/047; C10G 2300/208; C10G 2300/302; C10G 2300/308; C10G 2300/802
See application file for complete search history.

(56) References Cited

U.S. PATENT DOCUMENTS 3,509,037 A 4/1970 Tse
4,057,486 A * 11/1977 Meadus ..... C10G 1/045 208/415

(Continued)

OTHER PUBLICATIONS

International Search Report and Written Opinion issued Jan. 3, 2013 in Corresponding PCT/IB2012/055849 filed on Oct. 24, 2012.

*Primary Examiner* — Brian McCaig
(74) *Attorney, Agent, or Firm* — Oblon, McClelland, Maier & Neustadt, L.L.P.

(57) ABSTRACT

The present invention relates to a process for the recovery of bitumen from an oil sand comprising the following phases in succession: (a) mixing an oil sand with a diluent capable of reducing the viscosity and density of the bitumen contained in said oil sand, obtaining a first mixture (slurry) comprising diluted bitumen; (b) mixing said slurry with a basic aqueous solution (BAS) possibly containing salts to increase its ionic strength, capable of removing said diluted bitumen from said oil sand containing it, obtaining a second mixture (BAS-slurry) which can be separated into (i) a liquid phase comprising said diluted bitumen, a fraction of oil sand free of the bitumen removed and water; (ii) a sediment comprising the remaining fraction of said oil sand free of the bitumen removed, water and residual hydrocarbons which can be eliminated by subsequent washings; (c) separating a liquid phase comprising said diluted bitumen removed, from said BAS-slurry mixture; (d) recovering, from said liquid phase separated in phase (c), the removed diluted bitumen contained therein.

18 Claims, 1 Drawing Sheet

(52) U.S. Cl.
CPC . *C10G 2300/302* (2013.01); *C10G 2300/308* (2013.01); *C10G 2300/802* (2013.01)

(56) References Cited

U.S. PATENT DOCUMENTS

| | | | |
|---|---|---|---|
| 4,459,200 | A | 7/1984 | Dente et al. |
| 2008/0110803 | A1 | 5/2008 | Veltri et al. |
| 2008/0110804 | A1 | 5/2008 | Veltri et al. |
| 2008/0110805 | A1 | 5/2008 | Veltri et al. |
| 2008/0111096 | A1 | 5/2008 | Veltri et al. |

* cited by examiner

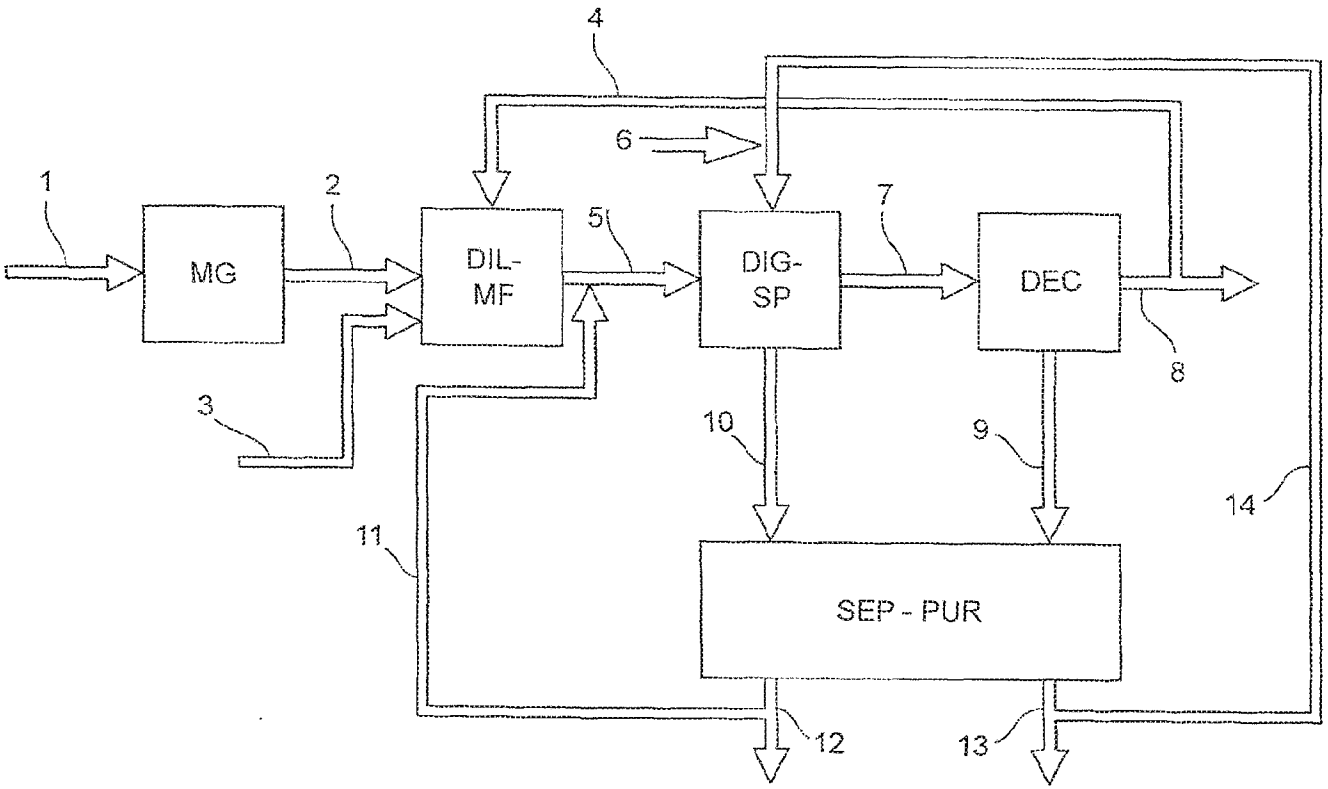
MG
DIL-
MF
DIG-
SP
DEC
SEP - PUR
1
2
3
4
5
6
7
8
9
10
11
12
13
14

PROCESS FOR THE RECOVERY OF BITUMEN FROM AN OIL SAND

CROSS-REFERENCE TO RELATED APPLICATIONS

This application is a National Stage of PCT/IB2012/055849, which was filed on Oct. 24, 2012. This application is based upon and claims the benefit of priority to Italian Application No. MI2011A 001977, which was filed on Oct. 31, 2011.

The present invention relates to a process for the recovery of bitumen from an oil sand.

More specifically, the present invention relates to a process for the recovery of bitumen from an oil sand extracted by mining, said process being particularly suitable for recovering bitumens having a high viscosity and low API degrees.

It is known that many hydrocarbon reserves currently available consist of water-wet or oil-wet oil sands, oil rocks, oil shales, containing so-called unconventional oils (or its precursors as in the case of oil shales), i.e. extra heavy oils or bitumens. These unconventional oils have an extremely high density, generally lower than 15° API, and an extremely high kinematic viscosity, generally higher than 10,000 Cst, said kinematic viscosity being measured at the original temperature of the reservoir, at atmospheric pressure, in the absence of gas: consequently said unconventional oils do not flow spontaneously under the reservoir conditions.

Oil sands are generally characterized by their mineralogy and also by the liquid medium which is in contact with the mineral particles of said oil sands.

Water-wet oil sands, for example, comprise mineral particles surrounded by a water layer, usually known as connate water. The oils contained in these water-wet oil sands are generally not in direct contact with the mineral particles, but rather form a continuous matrix around the granules. A relatively thin film of water encloses these mineral particles.

Oil-wet oil sands, on the other hand, can include small quantities of water, but the mineral particles are generally not surrounded by said water and the oils contained therein are in direct contact with said mineral particles. In the case of oil-wet oil sands, the extraction of oils is consequently more difficult with respect to the extraction of the same from water-wet oil sands.

Both water-wet oil sands and oil-wet oil sands generally contain a high percentage, about 90%, of mineral particles (prevalently quartz) having an average dimension ranging from 0.1 mm to 6 mm and can also be extremely acid (for example, with a pH lower than 4) depending on the mineralogy of these oil sands.

There are also oil sands with a mixed wettability having intermediate wettability characteristics between water-wet and oil-wet oil sands.

Various technologies are known in the state of the art for exploiting oil sands and for the extraction of the bitumen contained therein.

The recovery process of bitumen from oil sands extracted via mining called Clark Hot Water Extraction Process (CHWEP) is the most widely-used process in Canada among those currently operative.

The Canadian sands of the Athabasca region are typically sands of the water-wet type.

In the CHWEP process, the oil sand extracted is first subjected to a conditioning phase, which provides the vigorous mixing of the oil sand with water in the presence of NaOH, at a pH of about 9-10.

A slurry typically having a volume ratio bitumen/water/inorganic solids equal to about 60/30/10 is obtained from the mixing, which is generally realized at a temperature within the range of 50-85° C.

The slurry is then fed to a separation vessel, where it is left to settle with the formation of three superimposed layers (phases).

The first layer consists of a froth containing almost all of the bitumen originally present in the oil sand. This layer can be separated from the surface of the slurry by skimming.

The second layer consists of sand which settles on the bottom of the separation vessel.

The third layer which is separated is an intermediate viscous layer (middlings) containing dispersed clay particles and entrapped bitumen. This layer is generally sent to a floatation step for a further recovery of bitumen.

The froth containing bitumen, part of the solids (clay, sand and silt) and entrapped water, is sent to a second treatment unit for the recovery of the bitumen (froth treatment or de-frothing). In this second unit, the froth is heated, in order to eliminate the entrapped air, and treated with an organic solvent to reduce the density of the bitumen and facilitate its separation from the water in the subsequent centrifugation phase.

The bitumen is separated either by dilution with naphtha or using a paraffinic solvent. The choice of the type of solvent depends on the quality of the bitumen to be obtained from the process; the concentration of inorganic residues and water in the bitumen extracted depends, in fact, on the type of froth treatment used.

In the case of treatment with naphthas, the froth is diluted with the latter to reduce the density and viscosity of the bitumen in order to promote the coalescence of water in emulsion. The separation of the bitumen is obtained by centrifugation.

The bitumen obtained with naphtha treatment is low-quality as it contains high concentrations of solids and cannot be processed directly in refineries. It must be treated, on the contrary, before upgrading to eliminate residual naphtha, asphaltenes and solids, with a consequent significant loss of bitumen (up to 10-15% by weight of the bitumen originally present). Treatment with naphtha, however, has advantages in terms of yield to bitumen (higher than that with paraffinic treatment) and investment costs. High volumes of water, however, are required.

In the case of treatment with paraffinic solvent, dilution with the solvent (typically hexane) reduces the density and viscosity of the bitumen and causes flocculation of the water in emulsion and suspended solids; the separation is then effected by decanting.

Over a certain concentration, the paraffinic solvent also induces the partial precipitation of the asphaltenes present in the bitumen, favouring the entrapment of water and solids in aggregates that can be easily separated.

The product obtained with treatment with paraffinic solvent (de-asphalted bitumen) is of a higher quality than that obtained with treatment with naphtha and can be introduced onto the market.

Treatment with paraffinic solvent is also used for obtaining a bitumen with specifications which are such as to allow it to be processed in refineries (ebullated-bed hydrocracking).

Although the CHWEP process for the extraction of bitumen from Canadian oil sands offers numerous advantages, there are also various disadvantages.

The main disadvantages of the CHWEP process are:

consumption of huge quantities of water (2.5-4 units per unit of bitumen);

production of enormous quantities of tailings (1-2 $m^3$ per $m^3$ of bitumen produced);

production of high quantities of $CO_2$, even if lower than that of in-situ recovery processes.

A further and important critical aspect of the CHWEP process is represented by tailing ponds (i.e. artificial lakes where sand processing waste-products accumulate) into which the aqueous solutions containing entrapped fine solids and hydrocarbons deriving from the extraction process, are sent. In the tailing ponds, the separation (sedimentation) of water and bitumen from the suspended solids requires years, sometimes decades, thus creating a serious environmental problem. Canadian sands are in fact characterized by high clay contents (20-30% by weight).

A further critical aspect lies in the fact that the wastewater of the CHWEP process contains high levels of hydrocarbon, which is toxic, non-recoverable and with a high COD (Chemical Oxygen Demand) value; this makes tailing ponds substantially anoxic and incapable of sustaining animal and plant life.

The above drawbacks evidently make the CHWEP process extremely costly and with a high environmental impact.

The CHWEP process also has significant disadvantages with respect to flexibility of use. This process, in fact, can technically be applied only for the extraction of bitumen from water-wet oil sands and/or for the recovery of bitumen having a relatively low viscosity and API degrees higher than 8.

In the case of oil-wet sands or sands with a mixed wettability and containing bitumen having a high viscosity and reduced API degree, on the contrary, the CHWEP process is difficult to apply, unless significant variations in the process conditions are applied in order to favour the separation of the bitumen (for example, increase in the pH and increase in the recovery temperatures).

Considering these difficulties, bitumen extraction processes are known in the state of the art which have been specifically developed for the treatment of oil sands in which the CHWEP process does not provide good results.

These processes, alternative to the CHWEP process, are based on the use of water-solvent and/or diluent mixtures; extraction processes with a single solvent are also known.

The processes of the known art, however, have bitumen extraction yields which are not always satisfactory or, as in the case of processes with solvent alone, require process schemes/project solutions capable of guaranteeing the almost complete recovery of the solvent and control of the energy costs, both factors jeopardizing the commercial application of the process. To date there are no operative commercial plants employing solvent alone processes but only small pilot/demonstrative plants are known. An objective of the present invention is to overcome the drawbacks of the known art.

In particular, an objective of the present invention is to find a process for the recovery of bitumen from oil sands in which the conventional CHWEP process is not effective.

An objective of the present invention therefore relates to a process for the recovery of bitumen from an oil sand comprising the following phases in succession:

(a) mixing an oil sand with a diluent capable of reducing the viscosity and density of the bitumen contained in said oil sand, obtaining a first mixture (slurry) comprising diluted bitumen;

(b) mixing said slurry with a basic aqueous solution (BAS) possibly containing salts to increase its ionic strength, capable of removing said diluted bitumen from said oil sand containing it, obtaining a second mixture (BAS-slurry) which can be separated into (i) a liquid phase comprising said diluted bitumen, a fraction of oil sand free of the bitumen removed and water;

(ii) a sediment comprising the remaining fraction of said oil sand free of the bitumen removed, water and residual hydrocarbons which can be eliminated by subsequent washings;

(c) separating a liquid phase comprising said diluted bitumen removed, from said BAS-slurry mixture;

(d) recovering, from said liquid phase separated in phase (c), the removed diluted bitumen contained therein.

The fraction of oil sand free of said removed bitumen present in the above liquid phase (i) is only a minimum part of the oil sand treated. Most of this sand, in fact, forms the sediment (ii).

The process, object of the present invention can be used for treating oil sands of a varying lithological nature, containing bitumens of a varying chemical nature and concentration.

The process, object of the present invention, is particularly suitable for recovering bitumen from oil sands in which the CHWEP process is not effective (for example, due to the wettability characteristics of the sand and/or particularly high viscosity of the bitumen to be extracted).

The process, object of the present invention, is suitable, for example, for recovering bitumen from oil-wet oil sands, oil sands having a mixed wettability and consolidated sands having a large particle-size, such as sands containing high percentages of quartz (higher than 85% by weight) and low percentages of clays (lower than 5% by weight). The process of the present invention, however, can also be advantageously applied to water-wet oil sands, such as the Canadian sands in which clays are present in a quantity of about 20-30% by weight.

For the purposes of the present invention, the term "bitumens" indicates both the bitumens and extra heavy oils present in the solid matrix of oil sands. The bitumens and heavy oils are generally called unconventional oils.

The content of bitumen in the oil sands that can be treated with the process of the present invention typically varies within the range of 3-15% by weight with respect to the weight of the oil sand to be treated.

With the process of the present invention, bitumens having a high viscosity, generally within the range of 10,000-36,000 mPas (measured at 120° C., shear rate 100 $s^{-1}$) and a high density, typically within the range of 4-7° API, can be recovered from oil sands. These bitumens are characterized by a high content of asphaltenes (15-40% by weight) and a high acidity (Acid Number between 3 and 14 mg KOH/g).

The process of the present invention is based on a reduction in the viscosity and density of the bitumen entrapped in the oil sand and its subsequent transfer from the surface of the grains of the sand matrix.

The reduction in viscosity of the bitumen is obtained by mixing the oil sand with a suitable diluent compound under continuous stirring (pre-conditioning phase (a)).

The transfer of the bitumen from the oil-sand matrix (digestion phase (b)), on the other hand, is obtained by the addition of hot alkaline water to the sand/diluent (slurry) mixture obtained in the pre-conditioning phase.

Before subjecting the oil sand to the pre-conditioning phase (a), the oil sand is preferably subjected to crushing.

For a better understanding of the characteristics of the present invention, reference is made in the following description to FIG. 1, which illustrates a block scheme of the process according to the present invention.

With reference to FIG. 1, a charge of oil sand 1 is subjected to a first rough crushing (block MG) to obtain grains having dimensions in the order of 1-2 cm.

The stream of roughly crushed sand 2 obtained with said first crushing is subjected to a second crushing (block DIL-MF of FIG. 1) to obtain a further dimensional reduction in the grains to dimensions in the order of 5-10 mm (fine crushing, phase (a")).

The rough crushing phase (a') and fine crushing phase (a") can be effected with the help of equipment known in the art such as, for example, hammer mills, knife mills, or the like.

In a particularly preferred embodiment, the fine crushing, phase (a") is realized contemporaneously with the pre-conditioning phase (a).

It has been observed, in fact, that the presence of the diluent during the fine crushing favours the disaggregation of the rough fragments and formation of a homogeneous polyphase system.

Single hydrocarbon compounds or mixtures thereof, such as toluene, xylenes, kerosene, diesel, naphtha or mixtures thereof, can be used as diluents in the pre-conditioning phase.

The diluent used in phase (a) has a minimum boiling point higher than 60° C. and a maximum boiling point lower than 300° C.

Preferred diluents are kerosene and diesels as they contain aromatic fractions that avoid the precipitation of asphaltenes in the pre-conditioned bitumen. These diluents, moreover, are produced by the same refineries that will treat the extracted bitumen.

Moreover, kerosene is a particularly preferred diluent due to its lower density, which facilitates the separation of the bitumen.

In the pre-conditioning phase (a), the oil sand is mixed with the diluent compound in suitable weight ratios.

The quantity of diluent mixed with the sand to be treated must be sufficient for wetting the sand and diluting the bitumen entrapped therein, in order to lower its viscosity and density and favour its release.

Furthermore, the quantity of diluent used depends on the viscosity of the bitumen and temperature at which the mixing is effected.

The diluent is generally added to the oil sand in a "S/D" (sand/diluent) ratio ranging from 10:1 to 15:1 (weight ratio).

Generally, for bitumens having a viscosity higher than 10,000 mPa·s, the "B/D" ratio between the bitumen present in the oil sand and diluent added in phase (a) varies from 2:1 to 1:2 (weight ratio).

The diluent used in the pre-conditioning phase (a) advantageously at least partly consists of the hydrocarbon fraction recovered at the end of phase (c) (stream 4), which contains extracted bitumen mixed with the diluent used in phase (a). The remaining part of diluent necessary in phase (a), on the other hand, consists of fresh diluent (stream 3).

The mixing of the oil sand with the diluent is realized at a temperature ranging from 60° C. to 80° C. also depending on the quantity of diluent used.

In the pre-conditioning phase, the role advantageously exerted by the diluent in favouring the expulsion of the gases entrapped in the empty spaces of the sand matrix, with positive effects on the quality of the bitumen extracted from the process, is known art; the gas, if present in the subsequent digestion phase, upon being released, can in fact entrain drops of water, sand, etc. into the diluted product.

The mixing of phase (a) is realized with equipment known to experts in the field or specifically conceived for this operation.

In a preferred embodiment of the process, in the pre-conditioning phase (a), clean recycled sand wet with water (stream 11) is added to the diluted oil sand, before entering the removal phase with water (phase (b)). The clean recycled sand (stream 11) is a fraction of clean sand treated at the outlet of the bitumen extraction process (stream 12).

The slurry 5 obtained in the pre-conditioning phase (a) is fed to the subsequent digestion phase (b) (block DIG-SP).

In phase (b), a basic aqueous solution (SAB) (stream 6) is added to the slurry to favour the release of drops of bitumen and diluent from the sand matrix. The action of the hot SAB causes the progressive shifting of the organic phase from the sand matrix and its substitution with the aqueous phase.

The digestion phase (b) is realized in a mixer of the type known to experts in the field, or specifically conceived for this operation, keeping the sand under continuous stirring.

The release degree of the bitumen from the sand, after removal caused by the hot water added, depends on various factors, among which the viscosity of the diluted bitumen (the release is less if the temperature is not adequate), the difference in density between diluted bitumen and SAB and the bitumen-sand and water-sand interface tension. The sand-oil-water wetting angle and interface tension are in turn influenced by the pH and ionic strength of the SAB.

In the digestion phase (b), the water is used in a water/sand (W/S) ratio ranging from 0.4:1 a 6:1 by weight.

The SAB is prepared by dissolution in water of a basic compound, such as, for example, a hydroxide, a carbonate or a bicarbonate of an alkaline or alkaline-earth metal (for example NaOH, $Na_2CO_3$, $NaHCO_3$).

In the digestion phase (b), the SAB added to the slurry has a temperature within the range of 60° C.-90° C.

The pH of the SAB must be sufficiently high as to neutralize the acidity of the sands and bitumen, but at the same time avoid the formation of stable emulsions, favoured by high pH values. Preferably, the pH of the SAB ranges from 9 to 10.5.

Another factor which influences the yield of the extraction process is the ionic strength of the SAB. It has been observed, in fact, that the presence of high concentrations of ions in the SAB reduces the formation of both suspended solids and emulsified bitumen in the slurry-SAB.

When the SAB has a high ionic strength, the slurry-SAB is much more limpid and the separation of the solid phase (sediment) from the remaining liquid phase is easier.

Furthermore, when using a SAB with a high ionic strength, the difference in density between the sediment and liquid phase increases.

The SAB preferably has an ionic strength varying within the range of 0.5-1.

Further factors influencing the extraction yield of the bitumen are the mixing rate and duration (contact time) of the digestion phase (b).

The mixing rate must favour the contact between the aqueous phase and the organic phase surrounding the sand, in order to allow the bitumen bound to the sand to be replaced by water. The stirring is preferably slow, i.e. realized with a peripheral mixing rate ranging from 0.5 to 1 m/min. The stirring must allow the whole mass of sand to enter into close contact with the diluent, in the pre-conditioning phase, and with the basic aqueous SAB solution, in the digestion phase. Slow stirring in these two phases not only keeps the energy consumption low but also avoids the formation of froths or emulsions which are difficult to treat for the separation of the organic phase. Furthermore, at the above mixing rates, the release and entrainment of fine solids are reduced.

The contact time depends on the type of oil sand to be treated and on the time necessary for the water to substitute the diluted bitumen on the grains of sand. The contact time is greater for oil-wet sand and sands having a mixed wettability, whereas it is less for water-wet sands. The contact time generally ranges from 15 to 120 minutes.

This time is also characterized, in oil-wet sands, by an induction period associated with the perforation of the film of diluted bitumen on the part of the water, to allow its substitution on the sand particles. This time can be significantly reduced by the addition of clean recycled and water-wet sand. The slurry-SAB mixture obtained in phase (b) is a mixture that can be separated into various phases. If left to settle, in the absence of stirring, the slurry-SAB mixture is separated into two phases (i) and (ii):

(i) is a liquid phase 7, in turn consisting of two immiscible phases:
  - a first oily phase containing the bitumen removed in phase (b), the diluent, a small fraction of oil sand free of removed bitumen (that consisting of the finest solid particles);
  - a second aqueous phase substantially consisting of a layer of water;

(ii) is a sediment 10, comprising most of the treated oil sand, free of the diluted bitumen removed in the digestion phase (b), water and residual hydrocarbons that can be recovered with consecutive washings.

If left to decant (block DEC), the liquid phase 7 is in turn separated into a supernatant hydrocarbon phase 8 comprising the diluent and removed bitumen, and an intermediate aqueous phase 9 comprising, in dispersion, the fine fraction of treated oil sand (free of removed bitumen). The supernatant hydrocarbon phase 8 can be recovered with techniques known to experts in the field. The supernatant hydrocarbon phase is preferably recovered by decanting.

Finally, as already mentioned, the supernatant hydrocarbon phase 8 can be, at least partially, recirculated to the pre-conditioning phase (a) (stream 4) and possibly crushing phase (phases (a) and (a")) to reduce the concentration and consequently overall consumptions of diluent.

The total quantity of diluted bitumen that can be recirculated to phases (a) and (a") of the process ranges from 0.5 to 10 times by weight with respect to the weight of bitumen contained in the oil sand to be treated.

The intermediate aqueous phase 9 and sediment 10 separated in phase (b) of the process are subjected to traditional separation and purification processes (block SEP-PUR) in order to:

- reduce the concentration of hydrocarbons and fine solids, in the aqueous phase;
- eliminate the hydrocarbons present in the sediment, in order to fulfill the specifications for disposal without danger for the environment.

At the end of the extraction process and subsequent separation and purification phases (SEP-PUR), clean sand is obtained, free of the bitumen originally contained therein and water purified of hydrocarbons and residual fine solids of the process.

The clean sand (stream 12) and purified water (stream 13) are continuously eliminated from the process.

The clean sand 12, possibly without the recycled fraction 11, is destined for the reconstruction of the site from which it was extracted or for disposal.

When recycled, the clean sand (stream 11) impregnated with water, can be added to the diluted oil sand (slurry 5) before beginning phase (b) of the process. The clean recycled sand (stream 11) is a small part of the oil sand that is continuously discharged from the process (stream 12).

In a preferred embodiment of the process of the present invention, a fraction of the purified water, coming from the separation and purification phases (SEP-PUR), is recycled back to the extraction process (stream 14), where it is used for preparing the SAB used in phase (b) (block DIG-SP). The purified water can also be advantageously used for washing the sand after extraction of the bitumen.

The process of the present invention has various advantages with respect to the processes known in the state of the art for extracting bitumen from oil sands. In particular, with respect to the Canadian CHWEP process, the process of the present invention has the following advantages:

- more efficient and rapid dewatering processes,
- improvement in the bitumen's quality,
- reduction of solid/fine sediments in the extracted bitumen,
- reduction of bitumen losses,
- lower energy consumptions,
- high recycling of the aqueous phase and absence of tailing ponds.

The following embodiment examples are provided for purely illustrative purposes of the present invention and should not be considered as limiting the protection scope defined in the enclosed claims.

EXAMPLES

The effectiveness of the process of the present invention was verified in the recovery of bitumen from two different types of oil sand.

The physico-chemical characteristics of the oil sands tested are indicated in Table 1.

TABLE 1

| | Sand A | Sand B |
|---|---|---|
| BITUMEN | | |
| Weight percentage of bitumen | 12.5 | 12 |
| Viscosity of bitumen at 140° C. (shear rate 100 $s^{-1}$) | 5375 | 155 |
| °API of bitumen | 5.5 | 10.5 |
| P-value | 4.1 | 6.7 |
| AN (acid number) (mg KOH/g) | 7-9 | |
| SAND | | |
| Quartz (weight %) | 90-100 | 85 |
| Orthoclase (weight %) | 0-5 | 15 |
| Clays (weight %) | <5 | 0 |

The process according to the present invention was applied using kerosene as diluent. In phase (b) the SAB was added in a W/S (water/sand) ratio equal to about 4/1.

The experimental tests were carried out in a glass reactor having a capacity of 1.5 l, equipped with a sloping blade stirrer for moving the sand on the bottom of the vessel.

Recovery Test

Table 2 indicates the operative conditions of the recovery test carried out on the two different types of oil sand.

The tests were carried out on 150 g samples of sand, selecting a temperature for the digestion-removal treatment of 90° C. and a mixing rate of 4 rpm. The results of the recovery test, in terms of yield of bitumen extracted, are indicated in Table 2.

TABLE 2

| Test | Sand | SAB pH | S/D ratio | t contact (min) | Yield* (%) |
|---|---|---|---|---|---|
| 1 | B | 9.5 (NaOH) | 150/20 | 60 | 6 |
| 2 | B | 10.0 (NaOH) | 150/20 | 60 | 16 |
| 3 | B | 10.5 (NaOH) | 150/20 | 60 | 90 |
| 4 | B | 11 ($Na_2CO_3$) | 150/15 | 60 | 77 |
| 5 | A | 11 ($Na_2CO_3$) | 150/15 | 30 | 84 |

*= percentage of bitumen recovered referring to the total quantity of bitumen contained in the sand.

Tests with Recirculation of the Diluent

Tests were carried out to verify the effectiveness of the re-use of a fraction of the diluent-bitumen mixture obtained at the end of phase (c) in order to reduce the consumption of fresh diluent.

For this purpose, a synthetic mixture was prepared, consisting of bitumen (60% by weight) and kerosene (40% by weight), which was used as diluent in phase (a) of the process.

The specific operative conditions adopted and extraction yields of the bitumen are indicated in Table 3. The tests were carried out on 150 g samples of sand, at a treatment temperature (digestion-removal) of 90° C.

TABLE 3

| Test | Sand | pH | Sand (g) | Fresh diluent (g) | MR (g) | MR vs. bitumen % | rpm | t (min) | Yield (%) |
|---|---|---|---|---|---|---|---|---|---|
| 6 | B | 11.2 | 150 | 6 | 33.3 | 178 | 2 | 60 | 74 |
| 7 | B | 11 | 150 | 5 | 15 | 80 | 4 | 60 | 69 |
| 8 | B | 11 | 150 | 8 | 7 | 37 | 4 | 120 | 87 |

MR = recirculation mixture

From Table 3, it can be deduced that the best results in terms of extracted bitumen yield are obtained with recirculation percentages in the order of 40% by weight (calculated as weight of the recirculation mixture with respect to the weight of the bitumen to be extracted).

Tests carried out using the recirculation mixture only, on the contrary, provided low recovery yields of the bitumen.

Tests in the Presence of Salt

The effectiveness of the extraction process was also verified with a variation in the ionic strength of the SAB. The ionic strength of the SAB, in fact, influences the wettability of the sand and consequently the recovery yield of the bitumen.

The specific operative conditions adopted and extraction yields of the bitumen are indicated in Table 4. The tests were carried out on 150 g samples of sand, at a treatment temperature (digestion-removal) of the sand of 90° C. The ionic strength of the aqueous medium, modified by the addition of NaCl, was equal to 0.6 (typical value of seawater).

TABLE 4

| Test | Sand | pH | S/D ratio | rpm | t (min) | Yield (%) | %. of fines in the water phase* | %. bitumen* |
|---|---|---|---|---|---|---|---|---|
| 9 | B | 10 (NaOH) | 150/20 | 4 | 60 | 16 | | |
| 3 | B | 10.5 (NaOH) | 150/20 | 4 | 60 | 90 | 0.3 | 0.8 |
| 10 | B | 10 (NaOH + NaCl) | 150/20 | 4 | 60 | 82 | 0.08 | 0.03 |
| 11 | B | 10 ($Na_2CO_3$) | 150/20 | 4 | 60 | 18 | | |
| 12 | B | 10 ($Na_2CO_3$ + NaCl) | 150/20 | 4 | 60 | 88 | | |
| 13 | A | 10 (NaOH + NaCl) | 150/15 | 4 | 60 | 87 | | |

The tests showed that the presence of NaCl allows high recovery yields (>80%) at lower pH values (10 rather than 10.5), to be obtained with respect to the tests carried out without salt.

An additional positive effect of the presence of the salt is the reduction in suspended solids (fine products) and emulsified bitumen in the aqueous solution which appears much more limpid and easy to separate from the bitumen. The salinity of the water also favours separation as it increases the difference in density between the phases.

The invention claimed is:

1. A process for recovery of bitumen from an oil sand, the process comprising, in the following order:

(a) mixing an oil sand with a diluent capable of reducing a viscosity and density of the bitumen contained in the oil sand, in order to obtain a first mixture, which is a slurry comprising diluted bitumen;

(b) mixing the slurry with a basic aqueous solution (BAS) having an ionic strength within the range of 0.5-1, optionally comprising a salt to increase an ionic strength thereof, wherein the basic aqueous solution is capable of removing the diluted bitumen from the oil sand, in order to obtain a second mixture of a BAS slurry which is separated into (i) a liquid phase comprising the diluted bitumen, a fraction of oil sand free of the bitumen removed and water; and (ii) a sediment comprising a remaining fraction of the oil sand free of the bitumen removed, water and residual hydrocarbons which can be eliminated by subsequent washings;

(c) separating the liquid phase comprising the diluted bitumen from the BAS-slurry; and (d) recovering, from the liquid phase separated in the separating (c), a removed diluted bitumen contained therein.

2. The process according to claim 1, comprising, before the mixing (a), a rough crushing (a') and optionally a fine crushing (a") of the oil sand.

3. The process according to claim 2, wherein the fine crushing (a") occurs simultaneously with the mixing (a).

4. The process according to claim 2, wherein a part of the liquid phase comprising the removed diluted bitumen separated in phase (c) is recycled to the mixing (a), the fine crushing (a"), or both.

5. The process according to claim 1, wherein the diluent is a hydrocarbon compound or a mixture of hydrocarbon compounds having a minimum boiling point higher than 60° C. and a maximum boiling point below 300° C.

6. The process according to claim 1, wherein the diluent is at least one selected from the group consisting of toluene, xylenes, kerosene, diesel, and naphtha.

7. The process according to claim 1, wherein the liquid phase (b) is realized under one or more of the following conditions:

a temperature ranging from 60 to 90° C.;

a pH of the basic aqueous solution within the range of 9-10.5; and mixing with peripheral rate ranging from 0.5 to 1 m/min.

8. The process according to claim 1, wherein a sand/diluent (S/D) weight ratio ranges from 10:1 to 15:1.

9. The process according to claim 1, wherein a bitumen/diluent (B/D) weight ratio ranges from 2:1 to 1:2.

10. The process according to claim 1, wherein a water/oil sand (W/S) weight ratio ranges from 0.4:1 to 6:1.

11. The process according claim 1, wherein a contact time between the diluent, the basic aqueous solution, and the oil sand ranges from 15 minutes to 120 minutes.

12. The process according to claim 1, wherein clean recycled sand is added to the first mixture comprising the diluted bitumen before the slurry is mixed with the basic aqueous solution.

13. The process according to claim 1, wherein water of the liquid phase remaining at the end of the separation of the diluted bitumen removed in the recovering (d), is at least partially recycled to the mixing (b) and employed for the preparation of the BAS.

14. The process according to claim 1, wherein the bitumen to be recovered has a viscosity ranging from 10,000 to 36,000 mPa·s measured at 120° C., shear rate 100 $s^{-1}$ and a density ranging from 4 to 7 API degrees.

15. The process according claim 1, wherein the oil sand is oil-wet, water-wet or an oil sand with a mixed wettability.

16. The process according to claim 1, wherein the diluent is at least one selected from the group consisting of kerosene and diesel.

17. The process according to claim 1, wherein the diluent is kerosene.

18. The process according to claim 1, wherein clean recycled sand, which is water-wet, is added to the first mixture comprising diluted bitumen before the slurry is mixed with the basic aqueous solution.

* * * * *